US007779761B2

(12) United States Patent
Barry

(10) Patent No.: US 7,779,761 B2
(45) Date of Patent: Aug. 24, 2010

(54) UNDER-WAY VEHICLE TRANSFER

(76) Inventor: Leonard D. Barry, 19300 Pennington Dr., Detroit, MI (US) 48221

( * ) Notice: Subject to any disclaimer, the term of this patent is extended or adjusted under 35 U.S.C. 154(b) by 640 days.

(21) Appl. No.: 11/536,298

(22) Filed: Sep. 28, 2006

(65) Prior Publication Data

US 2007/0095243 A1 May 3, 2007

Related U.S. Application Data

(60) Provisional application No. 60/721,300, filed on Sep. 28, 2005.

(51) Int. Cl.
*B61D 3/00* (2006.01)
*B61K 1/00* (2006.01)
*B65G 67/00* (2006.01)

(52) U.S. Cl. ..... 105/355; 105/404; 104/20; 414/339

(58) Field of Classification Search ..... 105/355, 105/404, 370, 413, 407, 411, 72.2; 414/334, 414/339, 349, 350, 352; 410/28, 28.1, 3, 410/4, 5, 6, 13, 14, 15, 26, 27, 29, 29.1; 104/28, 104/29, 20

See application file for complete search history.

(56) References Cited

U.S. PATENT DOCUMENTS 1,139,411 A 5/1915 Gunn
3,596,730 A * 8/1971 Cecce ..... 180/236
4,130,208 A 12/1978 Barry
4,500,248 A * 2/1985 Kramer ..... 414/459
4,599,030 A * 7/1986 Skaalen et al. ..... 180/236
7,077,065 B2 * 7/2006 Tremblay et al. ..... 105/72.2

* cited by examiner

*Primary Examiner*—Mark T Le
(74) *Attorney, Agent, or Firm*—Gifford, Krass, Sprinkle, Anderson & Citkowski, P.C.

(57) ABSTRACT

A guided transport vehicle has a berth with open side and bottom for a roadway vehicle to be driven along side on a station driveway and obliquely steered into the berth and lifted for transport on the transport vehicle and lowered to another station driveway and obliquely steered out from the berth. The guided vehicle can be a railway car in a train on a track or guideway flush with station driveways for the transfer vehicle. The transfer vehicle can be a bus, truck, motor home, or platform for holding containers or vehicles. This transfer vehicle has all wheel parallel steering and can shift to front wheel steering at either end. End rollers guide the transfer vehicle parallelly in and out of the berth, and end lifts raise the vehicle for travel on the train above the track. The vehicle is controlled to accelerate to train speed and aligned before all wheels are turned together at an oblique angle to enter the berth.

18 Claims, 6 Drawing Sheets

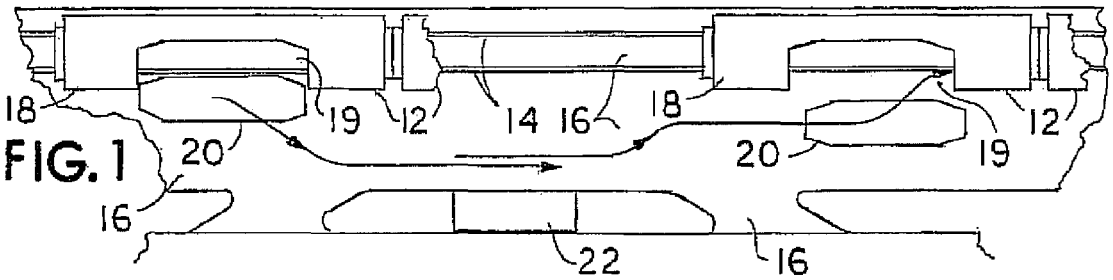
FIG. 1
FIG. 2
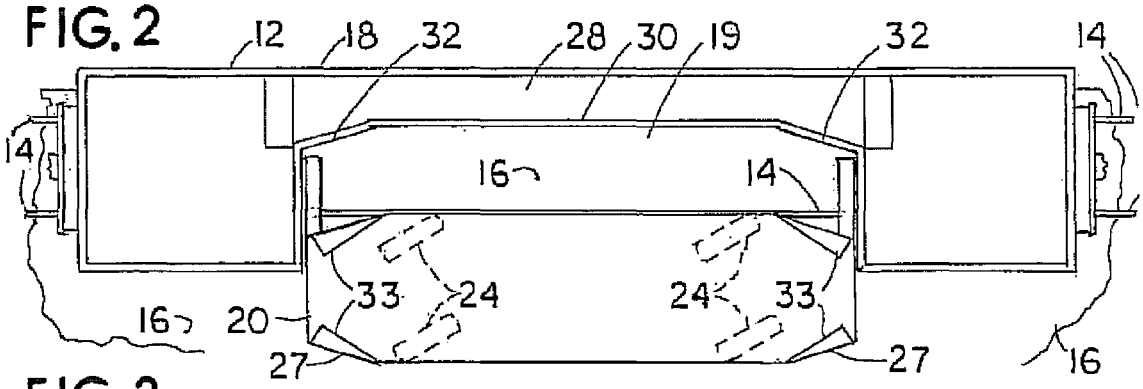
FIG. 3
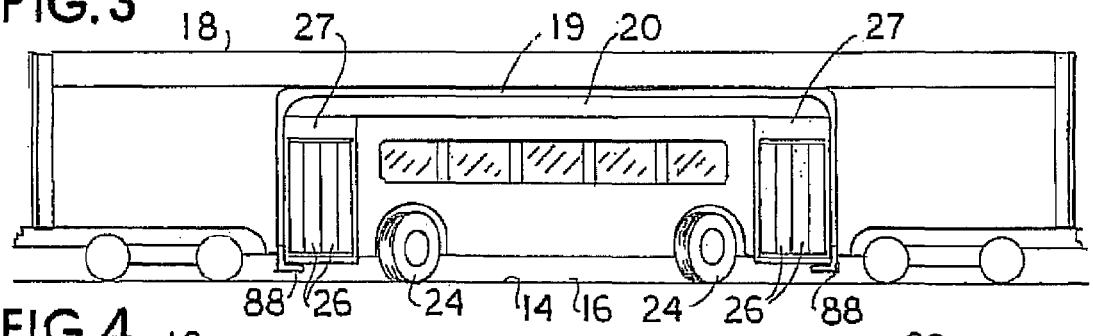
FIG. 4
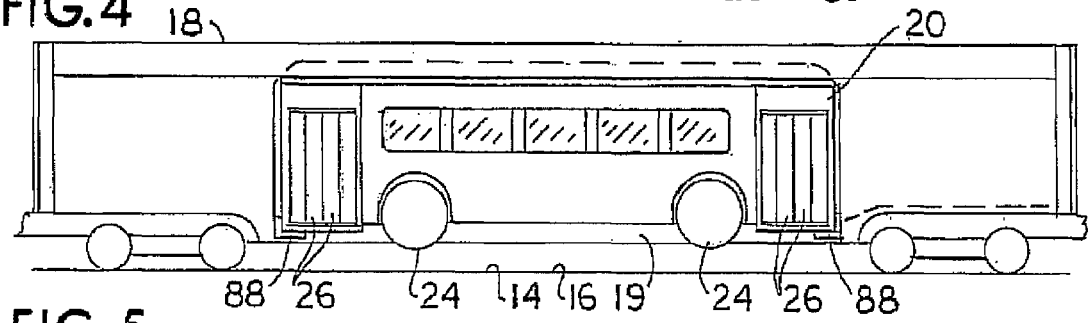
FIG. 5
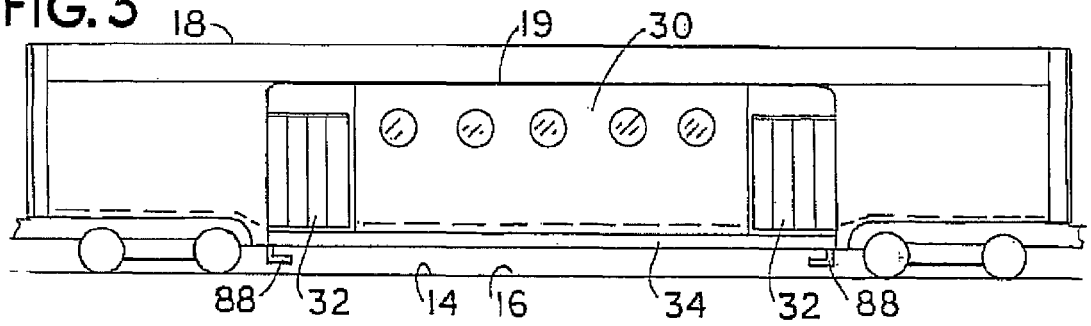

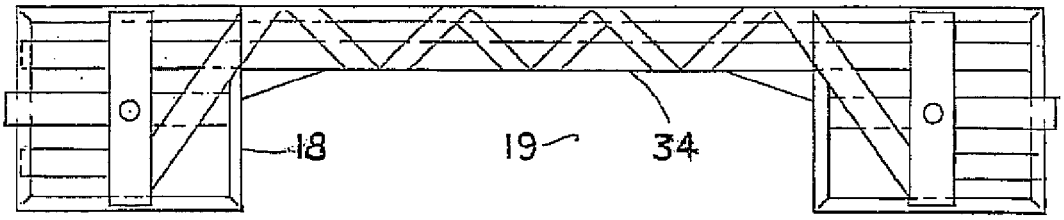
FIG. 6
FIG. 7
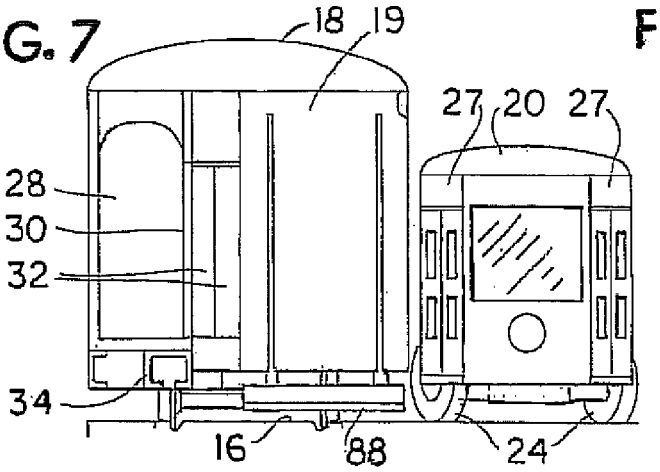
FIG. 8
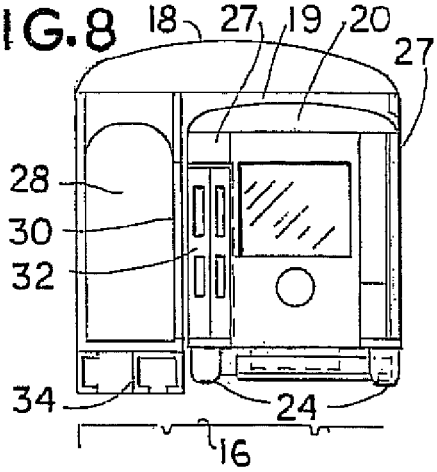
FIG. 9
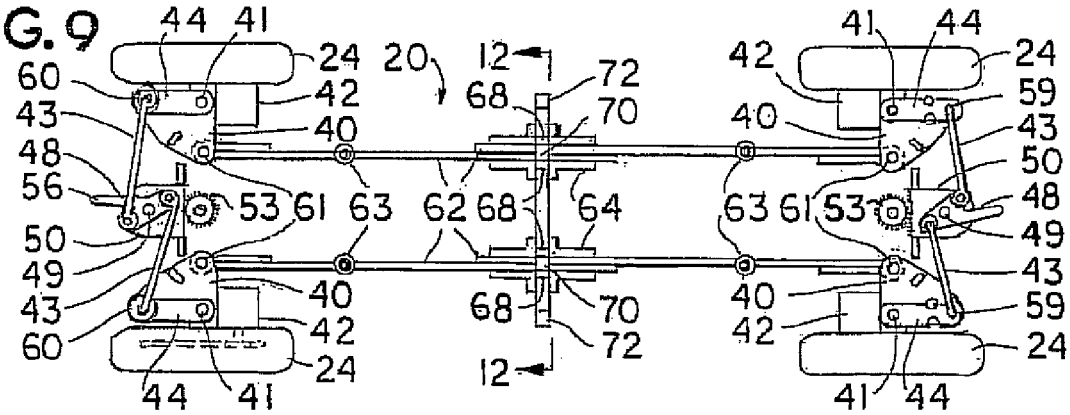
FIG. 10
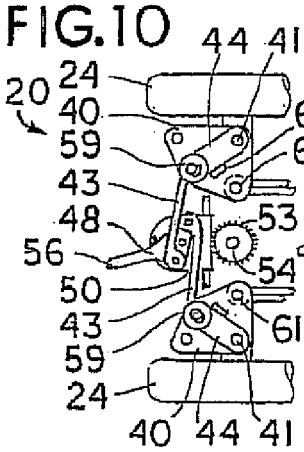
FIG. 11
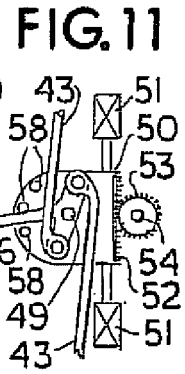
FIG. 12
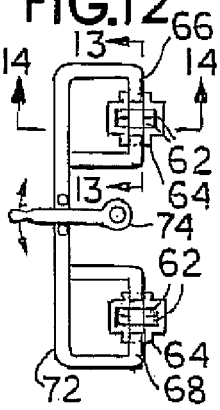
FIG. 13
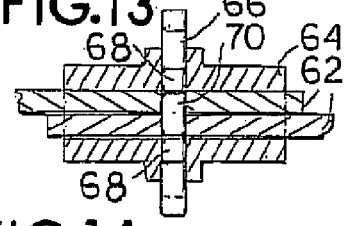
FIG. 14
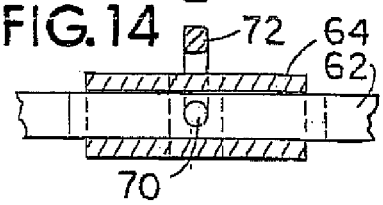

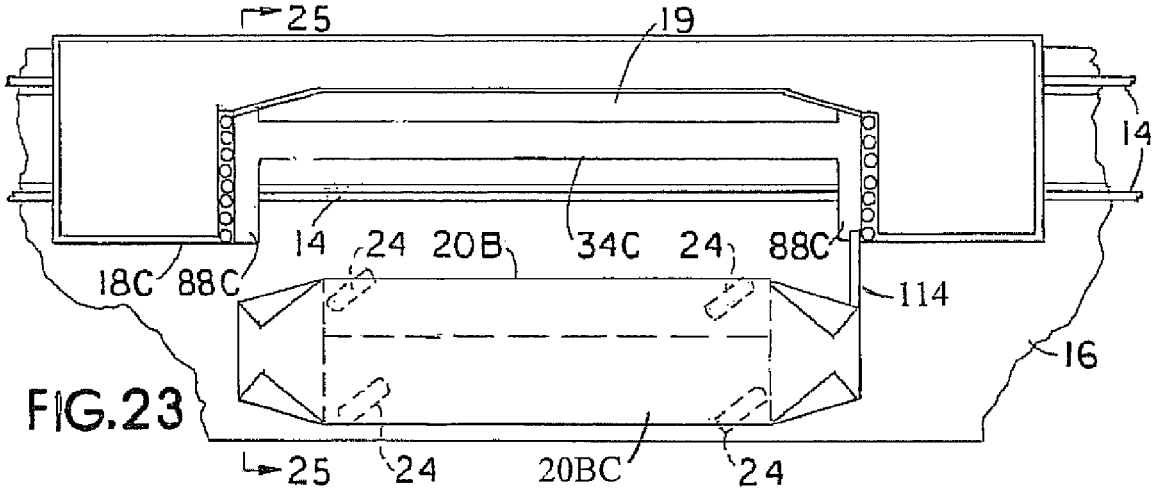
FIG.23
FIG.24
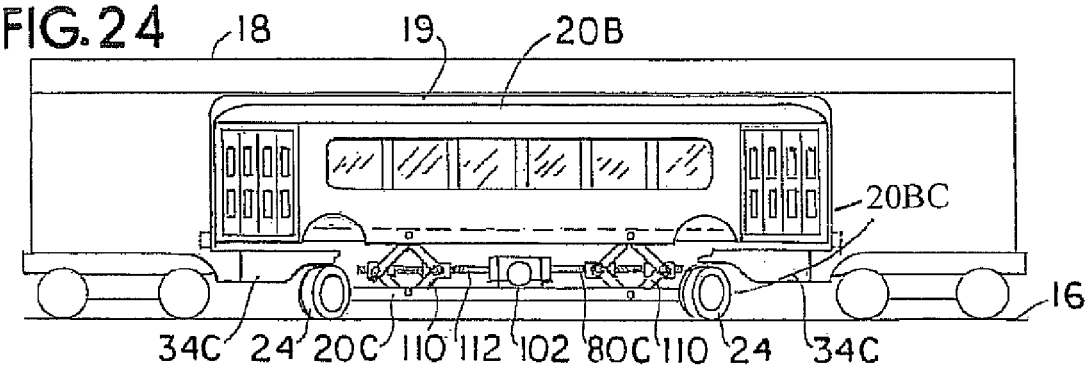
FIG.25
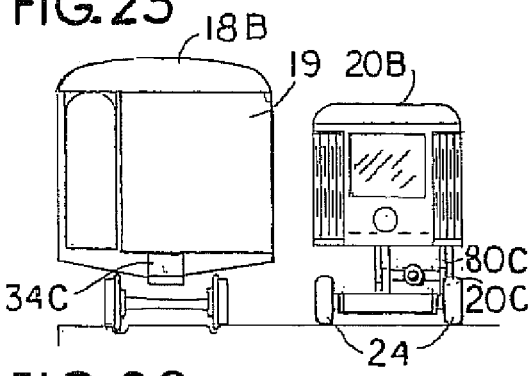
FIG.26
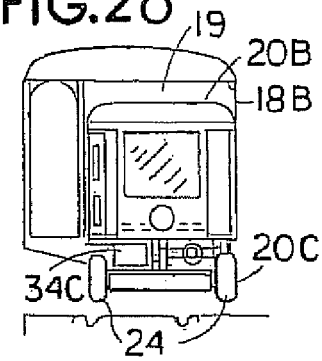
FIG. 27
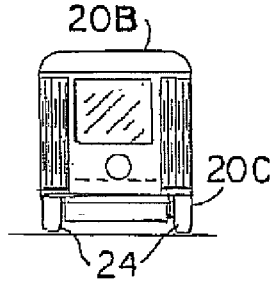
FIG. 28
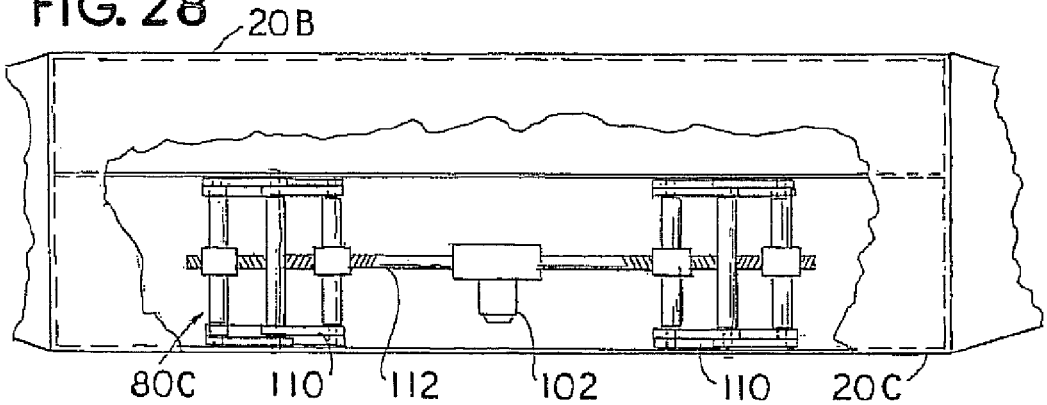

UNDER-WAY VEHICLE TRANSFER

RELATED APPLICATIONS

This application claims priority of U.S. Provisional Patent application Ser. No. 60/721,300 filed Sep. 28, 2005 which is incorporated herein by reference.

This invention is for transfer of a moving vehicle to and from another moving vehicle and is a further development from my U.S. Pat. Nos. 4,130,208 and 6,652,214 for loading and unloading trains nonstop.

FIELD OF THE INVENTION

My present invention transfers roadway vehicles to and from moving trains by steering and propelling the roadway vehicle parallel to the train to align at speed and steering all wheels to any desired oblique angle to enter a space for the vehicle under a transport car in the train running along a straight track along side a driveway which extends flush over the track to drive into or out from an open side and bottomless berth in the car.

BACKGROUND OF THE INVENTION

While it was proposed by J. A. Gunn in his U.S. Pat. No. 1,139,411 to provide a railway passenger transfer car to be guided by rail into a space under a passenger car moving in a train, at best, his work would result in a slow speed transfer and a weak design of the receptor car in the train. I propose the transfer car be replaced by a highway vehicle driven by an operator or radio controlled or programmed to meet the receptor car anywhere convenient along a driveway flush with the railroad track wherever alignment at speed occurs along my transfer run. This makes high speed transfer practical. Further I propose the sill of the receptor car be kept low near its present location on centerline below the container or body of the transfer car for least loss of strength to the receptor car. I further propose an aisle past the berth for the transfer car and the lifting of its wheels off the roadway and track while in the receptor car except during transfer to the from the train. My system requires no track rail modifications. My system provides a much lower and safe center of gravity for the receptor car even when empty.

SUMMARY OF THE INVENTION

It is an object to provide running transfer of a bus, truck, or other motor vehicle to drive into and out of an open berth in a railway car moving along a track embedded in a roadway.

It is an object to provide a transfer vehicle which has all wheel parallel steering to be steered to transfer to or from the moving train along the transfer driveway.

It is an object to carry the transfer vehicle on a railway car in a berth therefore that is only slightly larger than the vehicle and that can transfer to and from the berth while running parallel to the railway car.

It is an object to transfer a steerable container to or from a moving vehicle by steering the container along a driveway to transfer it into or out from the vehicle.

It is an object that the transfer car surround the railway car's sill on top, bottom and on one side.

Also it is an object to engage the transfer vehicle with a stopped train before the train is moved to complete the transfer.

It is an object to provide a transfer vehicle for fast transfer to and from a moving train anywhere along a station driveway in either direction of train movement.

It is an object to provide a bus for this transfer that has driver controls at each end so it need not be turned around at the end stations and so it can be left on the train at the city end station especially where cars are operated in reverse in a subway.

It is an object to transfer highway vehicles, especially busses to and from moving vehicles running on a track embedded along a driveway to eliminate station platforms, train dwell time, and wheelchair handling between bus and train.

It is an object to enable transfers along a long driveway run, wherever alignment at speed is reached, so alignment at speed need not be reached at only one particular point along the track but has a long tolerance distance along which transfers can be made anywhere by the driver.

It is an object to support the transfer vehicle on the driveway for substantially all of the transfer and lift and lower it in horizontal position in its berth on the train. It is an object to lift the transfer vehicle or its wheels to clear the track and driveway except when lowered for transfer.

It is an object to be able to recharge battery operated transfer vehicles from the train en route.

It is also an object to provide an action toy electric motor vehicle that can be radio controlled to load on and off a moving toy train.

BRIEF DESCRIPTION OF THE DRAWINGS

These other and further objects and features should become evident to those skilled in the art by study of this specification with reference to the drawings wherein:

FIG. 1 is a plan view of a transfer run with train traveling left to right on a railway track flush in a driveway with transfer vehicles (busses) on the driveway entering and leaving the train.

FIG. 2 is a plan view of a railway car with a transfer bus entering its berth (docking) therein, to larger scale.

FIG. 3 is a side elevation of FIG. 2.

FIG. 4 is a side elevation like FIG. 3 after the transfer bus is lifted and secured in the dock car.

FIG. 5 is a side elevation of the empty dock car.

FIG. 6 is a plan view of the sill frame of the dock car.

FIG. 7 is a sectional elevation on line 7-7 of FIG. 2 at the start of transfer.

FIG. 8 is that section after transfer is completed.

FIG. 9 is a plan of all-wheel and either-end-front wheel steering on the transfer bus set for all wheel steering.

FIG. 10 is a left end plan of this steering set for front end steering for this end.

FIG. 11 is a plan view of the tie rod length change assembly and steering rack.

FIG. 12 is a section on line 12-12 of FIG. 9 to show the pin and slug shift steering link to larger scale.

FIGS. 13 and 14 are sectional views of the steering front to rear connection sleeve of FIGS. 9 and 12 taken respectively on lines 13-13 and 14-14 of FIG. 12 to larger scale.

FIG. 23 is a plan view of a depot car with center sill about to be entered by a transfer vehicle bus running along side at train speed.

FIG. 24 is a side elevation of the transfer vehicle of FIG. 23 aligned with the car for transfer.

FIG. 25 is a sectional elevation on line 25-25 of FIG. 23.

FIG. 26 is FIG. 25 after transfer.

FIG. 27 is an end view of the bus lowered for highway operation.

FIG. 28 is a plan view of the lift mechanism on this bus to larger scale.

DETAILED DESCRIPTION OF THE INVENTION

Figure 15:
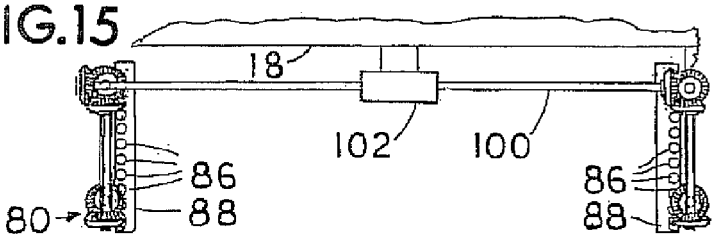
FIGS. 15 and 16 are respectively a plan and side view of a vehicle hoist on the dock car without and with the roadway transfer vehicle.
Figure 17:
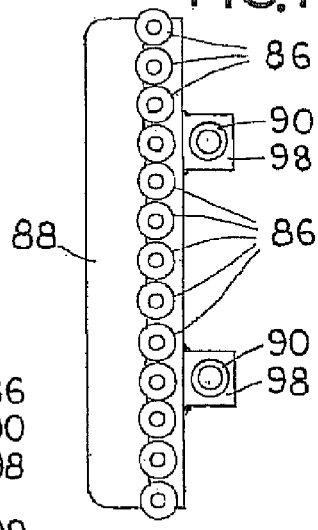
FIGS. 17, 18 and 19 are respectively plan, side, and end views of an end of the hoist lift for lifting and holding an end of the transfer vehicle.
Figure 16:
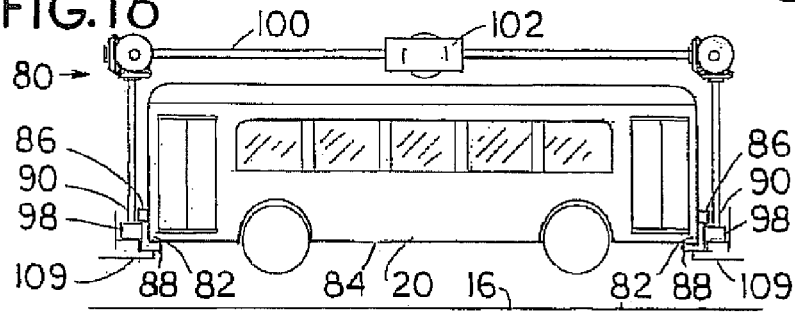
Figure 18:
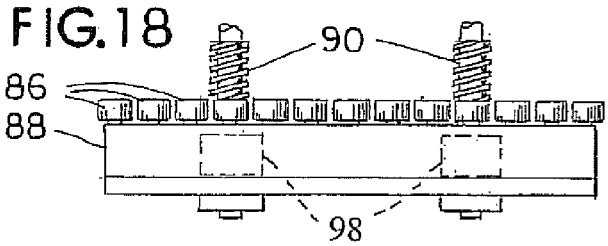
Figure 19:
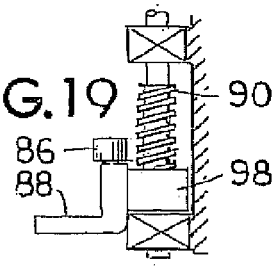

Referring to the drawings and in particular to FIGS. 1-8, train 12 is shown at two locations a short time interval apart traveling to the right on track 14 embedded flush for a transfer run, driveway 16. Train 12 has a depot car 18 with a dock or berth 19 for a transfer vehicle, bus 20. One bus 20 is shown leaving the car 18 at the left, FIG. 1, and another accelerating to align to drive in to the berth at the right. Berth 19 is open along the side and bottom of the car and extends about ¾ into the car for the bus to be driven in and out on driveway 16 as the train moves at a convenient speed for the bus driver. The driveway is paved flush with the top of the rails of track 14 for a distance along a straight stretch of track and has at least one traffic lane along the open berth side but preferably two lanes for the bus that leaves the berth to pass a bus operated to enter the berth as indicated by arrows, FIG. 1.

The train can travel in either direction on track 14 without turning car 18 around and the bus can be either turned around or preferably have driver controls and steering at each end so the bus need not be turned around especially at a city terminal.

The bus leaving the train can stop first at platform 22 before making a run distributing and picking up passengers for another train. The bus with passengers for the train would stop at the platform 22 to pick up passengers waiting for the train.

After the bus is driven into berth 19 its wheels 24 are lifted to clear the track and driveway and is further lifted as needed for passengers to enter and leave the bus in the train, FIG. 4.

The bus has doors 26 on tapered ends 27. Car 18 has a narrow aisle 28 separated from berth 19 by wall 30 and widened at the ends with doors 32 aligning doors 26 to provide wide entrance and exit to the car from the bus. Bus door panels, FIG. 21, have floor and ceiling wings 33 to keep the bus enclosed when the door panels are turned out in the car parallel to the car side.

Referring to FIGS. 5-8, car 18 has a sill 34 displaced from the centerline of the car to the aisle side of the berth to clear the berth area for the bus to be driven in and out on the driveway.

Referring to FIGS. 9-14, the four wheels 24 of the transfer vehicle 20 preferably are connected to turn in parallel together for all wheel steering for the vehicle to enter and leave its berth parallel to the car and be steerable at either end as front for normal Ackerman highway driving. Each wheel 24 is on an axle steering plate 40 pivotally mounted at 41 to the vehicle suspension and driven by an electric motor 42 secured to the steering plate. Plates 40 at each (front) end (both ends are front) are connected by a tie rod assembly 43. Plates 40 each have a steering transfer link 44 pivotally connected between pivot 41 and an end of the tie rod assembly 43.

Tie rod assembly 43 is two tie rods pivotally connected to opposite ends of a shift lever link 48 to shorten for Ackerman steering. Link 48 is pivotally secured central at 49 to a steering shift plate 50 mounted to slide transversely on a track or rods in sleeves 51, FIG. 11, fixed on the vehicle. Plate 50 has a gear rack 52 engaged by steering gear 53 on steering column 54. Lever link 48 has an arm 56 extending up to shift it between opposite sides of stop pins 58 on plate 50 to select parallel wheel steering FIG. 9 or Ackerman steering FIGS. 10 and 11. The outer ends of rods 43 are each connected to a hydraulic cylinder 59 on the outer end of a link 44 on each plate 40 to shift between stops 60 on plate 40 i.e. between the positions in FIGS. 9 and 10. Each link 44 is pinned in position to its plate 40 in these positions only. Plates 40 each support a hydraulic cylinder 59 whose rod pins the link 44 to its plate 40 and lifts its rod pin so the link 44 can be shifted with lever 48 to select parallel or Ackerman steering.

Axle plates 40 at opposite ends of the vehicle are connected at pivots 61 by overlapping links bars 62 pivoted at 63 to compensate for swing of plates 40 on pivots 41 and slip on each other and in sleeve 64 fixed to the vehicle frame. A segmented plunger 66, FIGS. 12 and 13, connects through a hole in sleeve 64 and in bars 62 from each end when wheels 24 are aligned parallel to the length of the vehicle. The plunger 66, FIGS. 13 and 14, has a slug or plug 68 on each side of a pin keeper 70 to line up slip fit in the holes. Pin 70 is as long as two bars 62 are thick. Each slug 68 is as long as one bar 62 is thick. The segmented plunger 66 can shift its keeper pin 70 in the hole when aligned, wheels parallel to the vehicle, to tie the two bars 62, one from each end of the vehicle, together to slide as one in the sleeve 64 to connect the rear and front wheels to turn parallel together for all wheel steering. The plunger can be shifted when the keeper pin 70 aligns holes in the sleeve and both bars 62 from opposite ends. Then keeper pin 70 can be shifted to connect the sleeve to the bar 62 connected to either end to lock those wheels parallel to the vehicle and insert a slug 68 in the other bar 62 to free that bar to slide in the sleeve for front wheel steering. The ends of plunger 66 are connected by yoke 72 outside of sleeve 64 to be shifted by linkage or controls by the driver to select front steering at either end or all-wheel steering.

Referring to FIGS. 15-19, dock car 18 has a hoisting mechanism 80 to lift the transfer vehicle, bus 20, off driveway 16 to height for passengers to move between the car and bus. The bus has lift bumpers 82 secured to ends of its frame chassis 84. Bumpers 82 engage between guide curb rollers 86 secured to a lift bar 88 transverse at each end of the berth and spaced to guide ends of the bus parallel in and out of the berth and extend under and below bumpers 82 to clear for the bus to enter and leave the berth.

Two jack screws 90 are secured to rotate each on a vertical axis spaced apart transversely at each end of the berth. Each screw 90 has a lift nut 98 pivotally connected two to a lift bar 88. The lift screws 90 at both ends of the berth are connected by gearing and shafting 100 and driven by gear motor 102 to lift and lower the bus substantially level in the berth.

Figure 20:
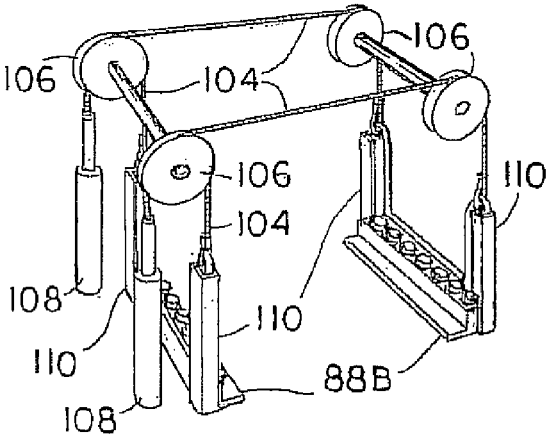
FIG. 20 is a perspective of a variation of the vehicle lift.

Referring to FIG. 20 for an alternative type of lift whereby end load supports 8813 are connected by wire rope or chain 104 run for each end of each support 88B up over pulleys or sprockets 106 and down to the rod end of cylinders 108 fastened to the vehicle. Cylinders 108 lift the load supports 8813 equally at each end of the berth. Safety stops 109, FIG. 16, extend under supports 88B to hold the load up until lifted for transfer. Tracks 110 guide upward extensions of supports 88B.

The bus 18 preferably can retract its wheels 24 up (kneel), as many busses do to kneel, but now to reduce or eliminate the lift requirement of hoist 80.

Figure 21:
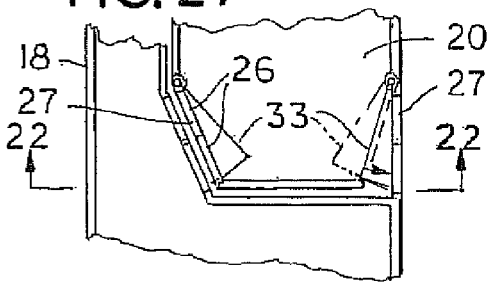
FIGS. 21 and 22 are respectively plan and sectional elevation on line 22-22 of FIG. 21 of a portion of the bus in the car showing the doors and floor alignments between the car and bus.
Figure 22:
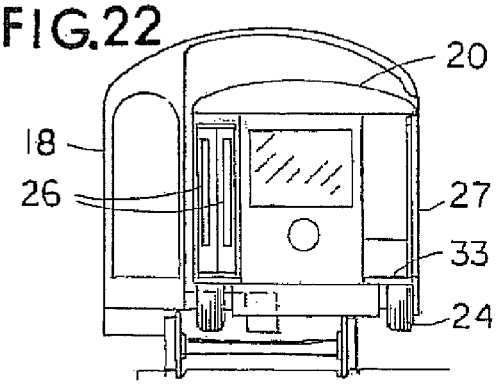

Referring to FIGS. 21-22, bus 18 has its end side doors 26 mounted in frame 27 hinged to the side of the bus to swing in to the angle of taper of the bus end and out to be flush with the side of the bus and train when thereon to streamline the train. Door frames 27 are limited in travel between stops and latch in end positions by latches controlled by the driver.

Operation

To transfer the bus to the train from the left, FIG. 1, the bus is stopped at platform 22 facing the right parallel track 14. With wheels 24 parallel to the bus, FIG. 9, the driver sets yoke 72 central, as in FIG. 12, for all-wheel steering with wheels 24 parallel to the track 14 and sets arms 56 to position all links 44 parallel for parallel steering. The driver drives forward turning all wheels 24 at a convenient angle to the lane next to track 14 and turns wheels 24 parallel to track 14 to wait for the train. When the train approaches, the bus driver accelerates to align empty berth 19 at train speed. When aligned at train speed the driver turns wheels 24 toward the berth to enter, reducing the steering angle to parallel as the bus fully enters the berth. The driver retracts the bus wheels 24 and a train attendant operates hoist 80 to secure and lift the bus up until the bus floor engages the bottom of the aisle floor. The lift bars interfit with the bus's bumpers and frame to secure the bus from sliding out the open side of the car. The driver extends the outside end door frames 27 to the sides of the car where they latch and locks the controls. The driver and passengers can leave the bus for the train.

To transfer the bus from the train, the bus with driver is loaded and doors 26 and 32 locked closed ahead of the transfer run. The bus is started to spin its wheels 24 at train speed and then lowered to support the bus on driveway 16 at train speed. The driver turns all wheels 24 out together from the train at a convenient angle to steer the bus parallel out from the train. After the bus has cleared the train and reached the lane away from the track the driver turns all wheels parallel to the driveway, stops and shifts to front wheel steering by shifting lever 56 at the front to position as in FIGS. 10 and 11 for Ackerman steering and shifts arm 74 clockwise to disconnect the pins 70 from forward rods 62.

Variations

Similar parts are given the same reference number with suffix added where modified.

Referring to FIGS. 23-28, railway car 18B has a center sill 34C through the area for booth 19 to provide a lighter weight car relative to its compression strength than car 18. Vehicle 20BC, a bus or truck, has its body 20B supported on a lift or hoist 80C on its chassis 20C. A jack screw 110 at each end of the chassis is connected by shafting 112 driven by reversible gear motor 102C, FIG. 24, so the bus body can be lifted above its chassis to clear over the car sill. See arm 114, aligned as in FIG. 23, to enter the bus body into the berth over end supports 88B and enter the chassis below the sill while running on the driveway. When the bus body is aligned over its berth, chassis 20C is retracted by the driver lowering hoist 80C. This sets and secures the bus body on end supports 88C in its berth, then lifts the bus's road wheels 24 off of the driveway to support the bus in its berth on the train.

Figure 29:
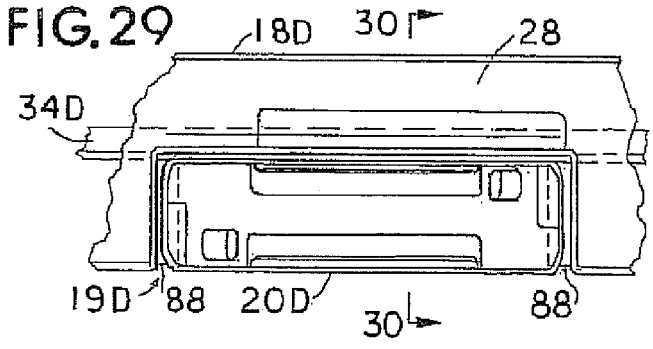
FIG. 29 is a plan view of a variation of a portion of the railway car with a narrow bus in its berth.
Figure 30:
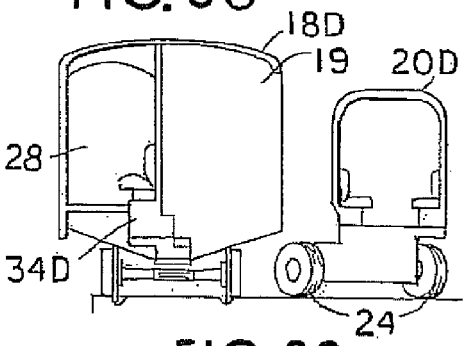
FIG. 30 is a section on line 30-30 of FIG. 29 to larger scale.

Referring to FIGS. 29 and 30, narrow bus body 20D is on one side of a low chassis to provide room for the sill 34D of car 18D to be above the bus chassis and along side of the bus body near the centerline along the car to strengthen the car for a given weight. This approximately ½ bus provides more aisle space on the car past berth 19 and room for seats along the aisle 28.

Figure 31:
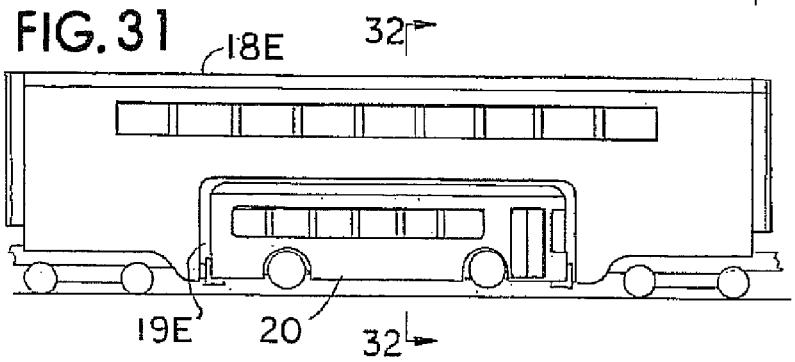
FIGS. 31 and 32 are side and section views of FIG. 31 of a bi-level passenger car with transfer vehicle, a bus, in its berth on the bi-level car.
Figure 32:
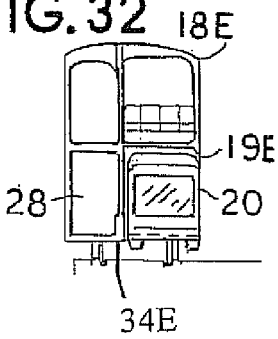
Figure 33:
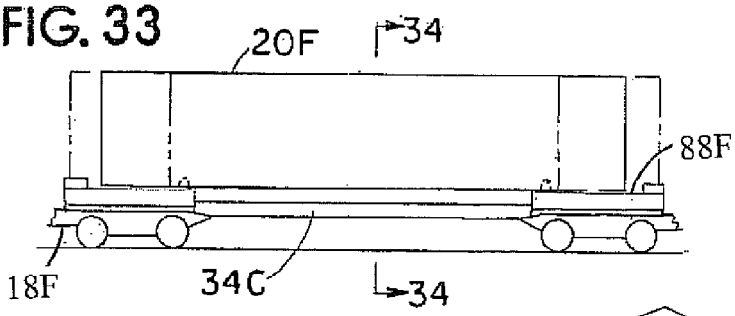
FIG. 33 is a side view of a railway car with container for transfer with an underrunning road vehicle not shown.
Figure 34:
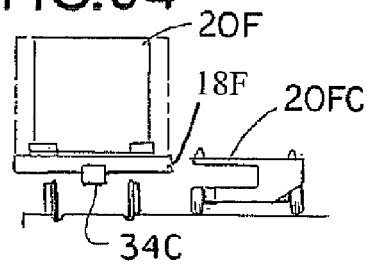
FIG. 34 is a sectional elevation on line 34-34 of FIG. 33 except with the road vehicle aligned along side of the railway car.
Figure 35:
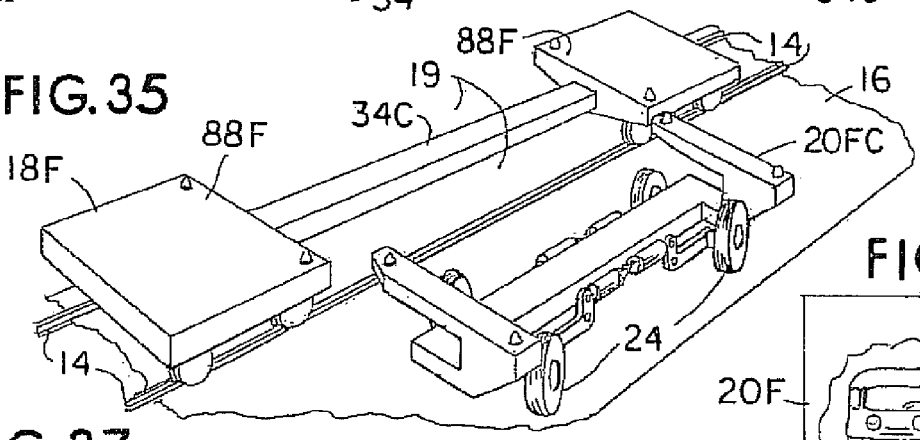
FIG. 35 is a perspective of this railway car and the aligned chassis for transfer of a container to and from this car.

Referring to FIGS. 31 and 32, car 18E has a second floor above bus 20 but needs the bus to be in berth 19E to help stabilize the car when operated at high train speeds. A berth through the car is possible with end bus doors but is not preferred or necessary with good system planning.

Referring to FIGS. 33-39, the body or load container 20F of the bus or truck can be detached from the chassis 20FC so the chassis can be driven out from the berth after the container 20F is set in and can be driven into a berth to set in a container. The container can be retrieved from the berth along a transfer driveway when another chassis 20FC enters below it and lifts it to clear to drive out with it.

Figure 36:
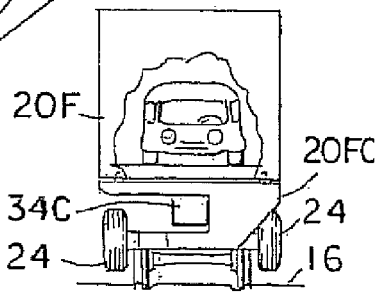
FIG. 36 is a section on line 34-34 of FIG. 33 to larger scale after transfer of a container to the car.
Figure 37:
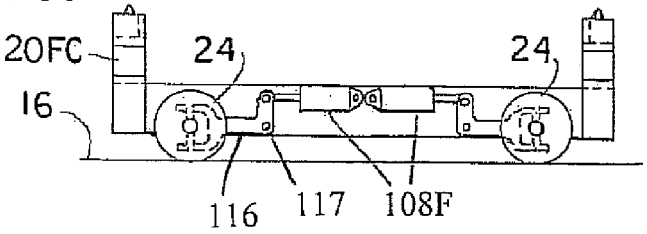
FIG. 37 is a side view of this transfer chassis.

Referring to FIGS. 33-37, a typical exposed center sill container car 20F has platforms 88F replacing ledges 88 to set container 20F across berth opening 19. Chassis 20FC has its wheels 24 each mounted on the end of a lift lever 116, pivoted at 117 to chassis 20FC and each connected to the rod end of a cylinder 108F whose head end is connected to swivel on chassis 20FC. Pressure to the head ends of cylinders 100F extend wheels 24 down from chassis 20FC to lift the chassis to lift a load 20F off car 18F onto the chassis for transfer. Pressure to the rod ends of cylinders 100F retract wheels 24 to set a load on the chassis down onto the car and lift wheels 24 off driveway 16 as shown in FIG. 36 to carry the load on car 20FC with chassis 20FC underneath on the sill 34C of car 18F.

Figure 38:
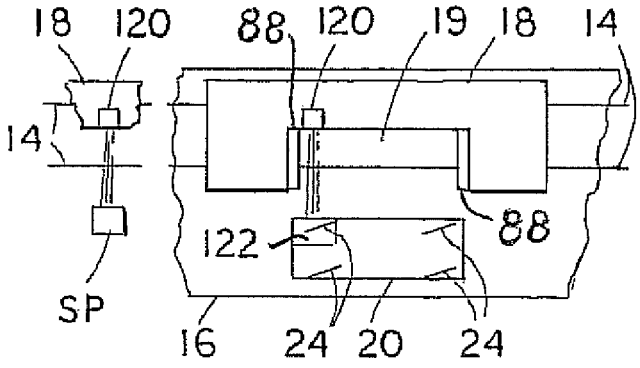
FIGS. 38 and 39 are time successive plan views of a radio controlled road vehicle chassis transferring to the railway receptor car.
Figure 39:
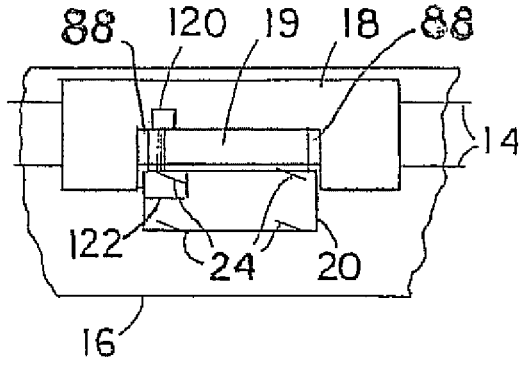

Chassis 20FC is preferably radio controlled or programmed to follow the procedure shown in FIGS. 38 and 39 by starting the chassis after a time inversely proportional to train speed when the train car's berth reaches point SP to accelerate at a controlled rate to align with the berth substantially at train speed. A light beam is extended from source 120 on the car to receiver 122 on the chassis to turn wheels 24 in parallel to steer the chassis parallel in under the berth and to control the speed of the chassis to that of the train and turn wheels 24 straight with the car when aligned in the berth by bumping a limit switch. Next the hoist is retracted enough to set the container or bus body on end ledges 88 in berth 19. Then the chassis can be programmed to be removed from the car 18 by turning wheels 24 still on the driveway 16 out in parallel.

Optionally chassis 20FC can be lowered further after setting the container on the car to rest the chassis on sill 34F, lifting wheels 24 off of the driveway to be hauled along under the car with the container 20F thereabove to a similar driveway where the container is to be put off by lowering wheels 24 (raising the hoist) parallel to the car onto that driveway, lifting the container up to clear the car and then turning wheels 24 out parallelly to steer the chassis with the container out from the car.

Having thus described my invention with preferred embodiments I intend to cover by the claims all embodiments, variations, applications, and parts which are within the true spirit and scope of this invention.

I claim:

1. In combination, a railway track, a driveway parallel along said track extending out over said track substantially flush with the top of said track for a transfer run on said driveway, a motorized vehicle having wheels and steering for running on said driveway, a train for running on said track having at least one car having a berth with open bottom and side for said vehicle to align and be steered to enter running aligned under said berth, supports on said car at each end of said berth while said train is running on said track on said driveway that extend under the ends of said vehicle when said vehicle is aligned under said berth when said wheels are on said driveway, and lift mechanism to engage said vehicle onto said supports and lift said wheels above said track for travel on said train.

2. In a combination as in claim 1, said motorized vehicle being a bus.

3. In a combination as in claim 1, said berth having said lift mechanism for lifting each end of said vehicle to clear said wheels above said driveway and track.

4. In a combination as in claim 1, said wheels being retractable and said supports being at a height low enough to clear said vehicle to enter said berth above said supports and high enough to support said vehicle above said driveway when said wheels are retracted.

5. In a combination as in claim 1, said motorized vehicle having at least two of said wheels at each end, said steering including all-wheel parallel steering and front end Ackerman steering selectable.

6. In a combination as in claim 5, said Ackerman steering being at each end so either end can be selected to be front.

7. In a combination as in claim 1, said car having a partition and at least one partition door separating said berth from the rest of the car, said vehicle having at least one vehicle door that substantially aligns said partition door when said vehicle is in said berth for human passage.

8. In a combination as in claim 7, said vehicle having at least one tapered end with said vehicle door therein, said car having an aisle along said berth widening at the end of the aisle to the tapered end of said vehicle with said vehicle door aligning said partition door to access said car through both doors when aligned.

9. In a combination as in claim 8, each side of said vehicle having a said tapered end at each end hinged to the sides of the vehicle to swing out to form a flush car and vehicle side when the vehicle is in the berth.

10. In a combination as in claim 1, said motorized vehicle having said lift mechanism to lift said wheels to set said vehicle down on said supports and lift said wheels above said driveway.

11. In a combination as in claim 1, said car having a longitudinal center sill exposed along each side, top and bottom, along said berth, said vehicle having a chassis and a body, said lift mechanism connecting said body onto said chassis to lift and lower said body on said chassis along one side of said vehicle to straddle said center sill, said chassis below and said body above to set said vehicle onto said car and raise said chassis off from said driveway for transport on said car.

12. In a combination as in claim 1, said car having a center sill open exposed, on both sides, top and bottom along said berth, said vehicle having a chassis and a body, structure connecting said body to said chassis along one side to position said body above said chassis and clear said center sill for said chassis to be driven under said sill from either side of said car to align substantially central under said sill with said body above said sill, said lift mechanism raising and lowering said wheels to respectively load and unload said car.

13. In a combination as in claim 1, said lifting mechanism being a hoist on said car connected to lift and lower said supports together to lift and lower said motor vehicle to travel on said car with said wheels above said driveway.

14. In a combination as in claim 1, said train moving along said driveway on said track, said motor vehicle being operated parallel to and along side of said train on said driveway to accelerate to train speed to align said motor vehicle with said berth, said steering including steering controls for an operator to turn all wheels in parallel for said motor vehicle to enter said berth parallel thereto when aligned and for steering parallel to said train when aligned with said berth, said lift mechanism being used to lift said wheels above said track until set down on a driveway for transfer off from the train.

15. A combination as in claim 1, said supports being on said lift mechanism on said car.

16. A combination as in claim 1, said supports being ledges fixed to said car, said lift mechanism being on said motor vehicle.

17. A combination as in claim 16, said lift mechanism being connected between said wheels and the portion of said vehicle supported thereon.

18. A railway car having a bottom and sides having a berth open in the bottom and one side of the car to drive a bus into under said car when moving to transfer to said car, support ledges spaced apart at ends of said berth to suspend said bus thereon for travel on said railway car and an aisle along an enclosed side of the car having a partition separating said berth from said aisle, said aisle and partition having widening tapered ends adjacent to berth doors in said partition in said tapered ends for allowing movement between the bus and said railway car.

* * * * *

UNITED STATES PATENT AND TRADEMARK OFFICE

CERTIFICATE OF CORRECTION

PATENT NO. : 7,779,761 B2
APPLICATION NO. : 11/536298
DATED : August 24, 2010
INVENTOR(S) : Leonard D. Barry It is certified that error appears in the above-identified patent and that said Letters Patent is hereby corrected as shown below:

Column 5, line 11, replace “8813” with --88B--

Column 15, line 14, replace “8813” with --88B--

Signed and Sealed this
Nineteenth Day of July, 2011

David J. Kappos

David J. Kappos
*Director of the United States Patent and Trademark Office*